United States Patent [19]

Rogers, Jr.

[11] Patent Number: 4,518,963

[45] Date of Patent: May 21, 1985

[54] AUTOMATIC INDICATOR FOR TOWER LIGHTS

[76] Inventor: Curtis F. Rogers, Jr., Rte. #5, Box 273, Fitzgerald, Ga. 31750

[21] Appl. No.: 371,799

[22] Filed: Apr. 26, 1982

[51] Int. Cl.[3] ..... G08B 21/00

[52] U.S. Cl. ..... 340/981; 315/132; 340/642

[58] Field of Search ..... 340/642, 981, 983, 643, 340/641; 315/130, 131, 132

[56] References Cited

U.S. PATENT DOCUMENTS 3,828,334 8/1974 Wallace ..... 340/642 X 4,253,042 2/1981 Jacobs ..... 340/642 X

*Primary Examiner*—Jerry W. Myracle

*Attorney, Agent, or Firm*—Newton, Hopkins & Ormsby

[57] ABSTRACT

The top, flashing lights and steady-burning side lights placed on an elevated obstruction to warn aircraft are monitored by a failure-detecting circuit. The circuit includes circuit components which detect and indicate the failure of either or both top lights, the latter case possibly indicating the alternative of continuous operation thereof, and for detecting and indicating one or more failures of the side lights. Provision is made for remotely actuating an internal latching relay which so changes internal connections that all detecting and indicating components should response.

10 Claims, 1 Drawing Figure

AUTOMATIC INDICATOR FOR TOWER LIGHTS

BACKGROUND OF THE INVENTION

Many and various circuits have been proposed to detect and indicate faults, and often such circuits monitor lighting or signalling circuits. Examples are to be found in the following U.S. Pat. Nos.:

3,143,729—Power
3,626,401—Flieder
3,644,886—Sabaroff
3,710,157—Wright
3,855,586—Jacobs
4,259,659—Ariyoshi et al However, the problem encountered in aircraft signalling light systems which are required on unusual obstructions, such as towers, chimneys and the like, is particularly troublesome because mere lamp failure is not the only serious fault which may be encountered. Rather, such systems usually employ top lights which flash intermittently. Obviously, a major fault can exist when one or more of such top lights fails and also when the flasher unit has failed either in the "on" or the "off" conditions. For the side lights, it is sufficient to know when at least one of them has failed.

SUMMARY

Accordingly, it is an object of this invention to provide circuitry which responds to all of the major fault conditions of aircraft obstruction warning light systems.

Basically, the invention includes means for producing a d.c. signal whose amplitude is related to current consumed by the flashing, top light warning and for producing an intermittent signal whose frequency is related to the "on" times of the flasher, in combination with means responsive to the d.c. signal to detect and indicate failure in the top light warning and means responsive to the intermittent signal for detecting and indicating failure of the flasher in the "on" condition.

Since two top lights are often employed, the invention comprehends a system responsive to the magnitude of a d.c. signal indicative of the current drawn by the top light for detecting and indicating failure of one of the top lights and for detecting and indicating failure of both of the top lights. The first indication unambiguously defines a single top light failure whereas the second indicates either failure of both top lights or failure of the flasher in the "off" condition. In addition, the circuit may include components responsive to flasher operation to detect and indicate failure of the flasher in the "on" condition.

DESCRIPTION OF THE PREFERRED EMBODIMENT

Figure 1:
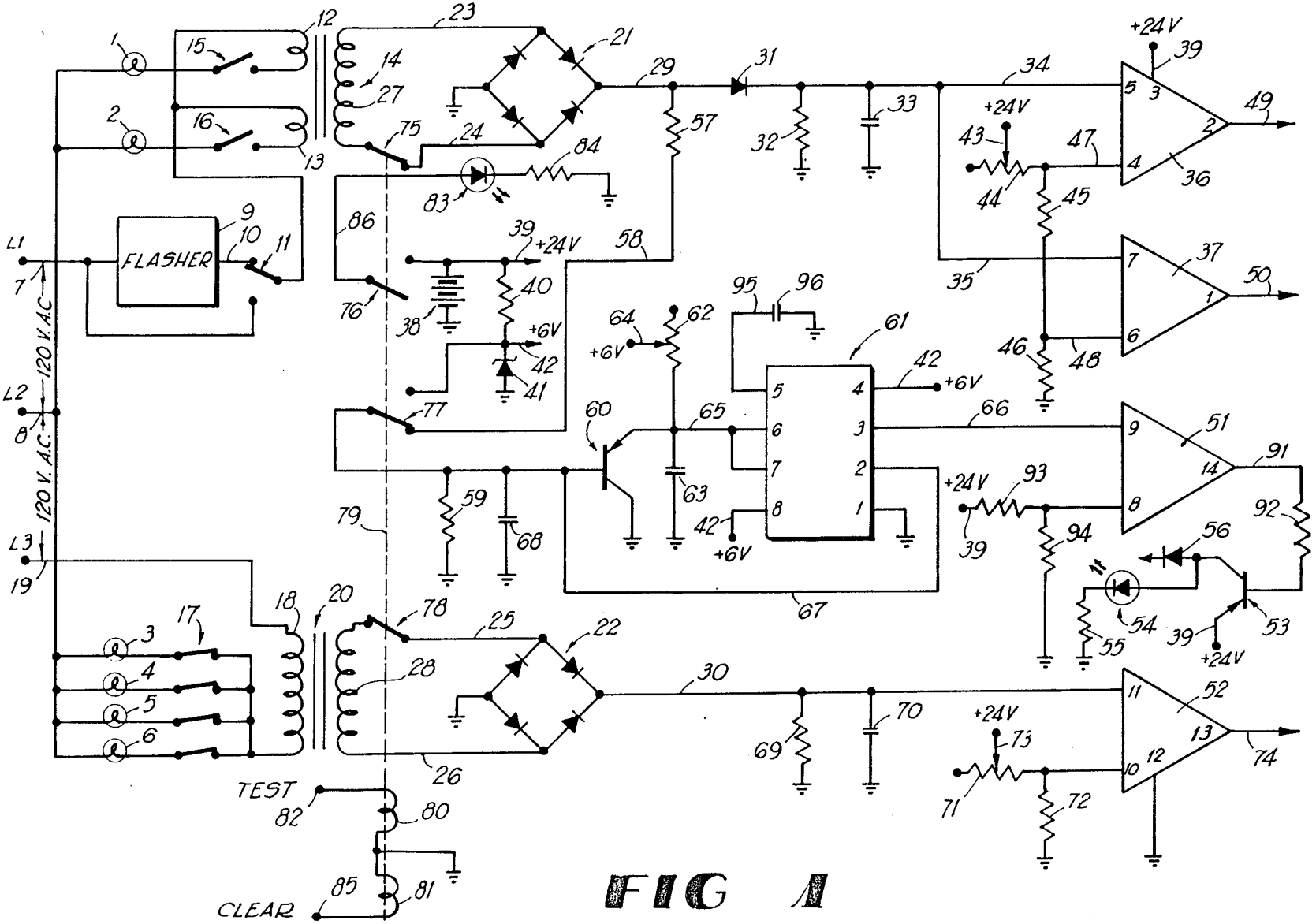
FIG. 1 is a schematic diagram of the circuitry and main functional apparatus of the present invention.

Referring to the drawing, six incandescent lights are indicated therein at 1–6. The lights 1 and 2 are powered by electrical energy from the 120 volt, 60 cycle supply provided at the conductors 7 and 8 through the flasher unit 9 which is of conventional construction. The flasher has an output terminal at 10 which is connected by a switch 11 to the respective lights 1 and 2 through the primary windings 12 and 13 of a transformer indicated generally at 14. The disconnect switches 15 and 16 are provided for safety purposes and the previously mentioned switch 11 will be seen to constitute an override for the flasher 9, the purpose of which will be presently apparent. The remaining lights 3, 4, 5 and 6 are connected through the several switches associated therewith, as indicated at 17, through the primary winding 18 to the source conductor 19. The primary winding 18 forms part of the second transformer indicated generally at 20. The two transformers 14 and 20 are connected to respective diode rectifying circuits indicated generally at 21 and 22, opposite points in these two bridges being connected by respective conductors 23, 24 and 25, 26 to the respective secondary windings 27 and 28 of the two transformers. Thus, the diode bridge 21 in association with its transformer 14 produces "bursts" of 60 cycle pulses at the conductor 29, the bursts being separated by the "off" time of the flasher 9 and the amplitudes of the pulses being dependent upon the current drawn by the two load lamps 1 and 2. The other diode bridge 22 produces an uninterrupted train of output pulses at the conductor 30 whose frequency is at the 60 cycles of the 120 volt source across the conductors 8 and 19 and whose amplitudes are related to the current drawn by the four load lamps 3–6.

The conductor 29 separates into two paths one of which is through the isolating diode 31 to a resistor 32 and associated capacitor 33, the value of which is sufficiently large as to smooth the ripple produced by the bursts of 60 cycle rectified pulses and to produce thereby a steady d.c. voltage output at the conductors 34 and 35 which are applied to the input lines 5 and 7 of a quad comparator integrated circuit, type 339, two quarter sections of which are indicated by the reference characters 36 and 37.

The failure-detecting circuit of this invention is self-contained and for this purpose is provided with a 24 volt battery 38 providing 24 volts d.c. at the conductor 39. Additionally, there is provided a dropping resistor 40 and a Zener diode 41, the junction between which provides a regulated 6 volt supply at the conductor 42. The 24 volt supply is connected to the movable tap 43 of a resistor 44 which together with the two resistors 45 and 46 forms a voltage dividing chain.

The junction between the resistors 44 and 45 is connected by the conductor 47 to the inverting input pin 4 of the comparator 36 whereas the junction between the resistors 45 and 46 is connected to the conductor 48 connected to the inverting input pin 6 of the other comparator section 37. The movable tap 43 is adjusted such that if both of the lights 1 and 2 are operating and the flasher 9 is also operating, the voltage at the conductors 34 and 35 is sufficient to exceed the voltages at the respective inputs 47 and 48 and thus maintain the outputs of these comparator sections at the respective conductors 49 and 50 "high". By properly choosing the values of the resistors 45 and 46, the burn-out or failure of one of the lights 1 or 2 would so decrease the amplitudes of the bursts of pulses at the conductor 29 that the voltage build-up on the capacitor 33 will drop sufficiently such that the voltage level at the input 34 to the comparator 36 is less than the input at the conductor 47 thereto while the input at 35 to the comparator 37 still remains higher than the input at the conductor 48. Thus, the output at the conductor 49 will go "low" while that at 50 will remain "high".

Each of the comparator sections 36, 37, 51 and 52 illustrated in the drawing will be used to control a transistor such as that indicated at 53 such that when the output conductor of a comparator section goes "low" the associated transistor 53 will conduct. A resistor 92 is connected between the output of each comparator and the base of the associated transistor 53 to limit the base current. An LED 54 may be connected to the collector of this transistor in series with a suitable current limiting resistor 55 so that a visual indication is given of the corresponding failure. Additionally, the collector may be connected through a suitable protecting diode 56 to an external alarm circuit.

Reverting to the particular comparator sections 36 and 37, it will be appreciated that if both of the lights 1 and 2 fail or burn out, the voltage on the capacitor 33 will decay to zero so that both of these comparator sections will indicate a failure. Thus, the comparator section 36 is used uniquely to indicate that one of the lights 1 or 2 has failed whereas an output signal from both of these comparator sections will indicate either that both lights 1 and 2 have failed or that the flasher unit 9 has failed in the "off" position. In any event, this is a major fault condition and indicates that repair personnel must be sent to the site for correction of the fault. It will be understood that a routine procedure at the site if both of the lights 1 and 2 have indicated failure is to throw the switch 11 and thus override the flasher 9. If this override energizes the lights 1 and 2, the flasher 9 obviously is at fault and must be changed.

The other path or branch from the conductor 29 is through the resistor 57, over the conductor 58 and the resistor 59 to apply signals to the base of the transistor 60. The transistor 60 is associated with a binary device 61 which may be an integrated circuit, such as a standard 555 Timer. The transistor 60 is associated with the timing circuit formed by the resistor 62 and the capacitor 63 in series. The movable tap 64 of the resistor 62 is connected to the 6 volt supply conductor 42 and the tap is adjusted such that the voltage at the conductor rises to the full six volts only after a time greater than the normal "on" condition of the flasher 9. This conductor is connected to pins 6 and 7 of the device 61 and it will be appreciated that the output on the conductor 66 connected to the output pin 3 of the device will be "high" so long as the inputs at pins 6, 7 and 2 thereof are not all "high". The input pin 2 is connected by means of the conductor 67 to the base of the transistor 60 and a capacitor 68 is provided to shape the incoming pulses to provide a proper clock input at the pin 2. A capacitor 96 is connected by means of the conductor 95 to input pin 5 so as to prevent unwanted triggering of the device 61. The output of pin 3 of device 61 is connected by means of conductor 66 to input pin 9 of comparator 51. The input pin 8 of comparator 51 is connected to the junction between the voltage dividing resistor chain 93 and 94 with the opposite end of resistor 93 being connected to the 24 volt supply, as shown.

The transistor 60 normally conducts and thus holds the inputs at the pins 6 and 7 at 0 volts. However, the incoming pulses of each "burst" turn the transistor 60 off and thus allow the voltage at the conductor 65 to rise toward 6 volts. If the flasher 9 has failed in the "on" state, this condition persists and the voltage at the conductor 65 reaches the requisite value such that the next incoming clock pulse at the conductor 67 causes the output at the pin 3 to go "low" and thus actuate the comparator 51 output. As noted, the movable tap 64 of the resistor 62 is so adjusted so as to prevent this change of output state so long as the flasher 9 is operating and the "on" times of the flasher are of sufficiently great durations. If the flasher 9 fails in the "off" condition, the comparator 51 will not respond but, in that case, the two comparators 36 and 37 will respond as noted hereinabove. If one top light should fail and flasher 9 should fail in the "on" condition, comparator 51 will be actuated along with the comparator 36.

The system as so far described is useful in detecting failures in a system employing a pair of lights 1 and 2 energized intermittently by a flasher unit 9. Thus, the system is useful in connection with warning lights which must be attached at the top of obstructions of unusual height, to serve as an aircraft warning system.

Usually, such towers or the like will also be required to be provided with a number of side lights which steadily burn and this is the purpose of the lights 3–6 previously described. In this case, it is of interest to determine a condition when one of these side lights fails and this is the purpose of the comparator 52 which receives its input from the diode bridge 22. As shown, the input pin 11 is connected to the conductor 30 to receive a steady d.c. signal developed across the resistor 69 and the smoothing capacitor 70. The input pin 10 is connected to the junction between the voltage dividing resistor chain 71 and 72, the movable tap 73 of the resistor 71 being connected to the 24 volt supply, as shown. This movable tap 73 is adjusted so that when all four of the lights 3–6 are drawing current, the voltage level at the pin 11 is higher than that at the pin 10 whereas, when one of the lights 3–6 has failed, the voltage level at the pin 11 drops below that at the pin 10 and the comparator 52 thereby provides a "low" output at its output conductor 74.

A further feature of the invention involves the utilization of a latching relay for the purpose of permitting remote testing of the unit. As shown in FIG. 1, the four switches 75–78 are commonly actuated as indicated at 79 by one or the other of the relay windings 80 and 81. These components may form part of a latching relay and the winding 80 is provided with a terminal 82 by means of which a voltage from a remote site may be momentarily applied to actuate the switches 75–78 into the opposite position from those shown. In this case, the connections to the two diode rectifying bridges 21 and 22 are broken, the base of the transistor 60 is switched over to the 6 volt supply and the "test" indicating LED 83 in series with the current limiting resistor 84 are connected to the 24 volt supply line 39. Breaking the input to the bridge 21 causes both of the comparator sections 36 and 37 to respond and the LEDs provided in association therewith give an indication to the observer that these two portions of the circuitry are in proper operating order. Likewise, the connection of the transistor base 60 to the 6 volt supply is sufficient to turn the transistor off and likewise to place a 6 volt input at the pin 2 of the device 61. Because the transistor 60 is now off, the capacitor 63 rises to the full 6 volts and all of pins 2, 6 and 7 of the device 61 are at 6 volts, thus changing the state its output 66 and causing the comparator section 51 likewise to respond. Lastly, the switch 78 breaks the input to the bridge 22 and allows the comparator section 52 to respond. When the test is completed, the remote operator sends a momentary signal to the clear terminal 85 which actuates the latching relay back to the normal position as shown in the drawing. The remote testing circuit is optional and may be omitted if desired, in which case the "test" LED is omitted and the circuits made in a normal position by the switches 75, 77 and 78 are hard wired.

What is claimed is:

1. A failure-detecting circuit for a signalling system having a top warning illumination and a flasher for intermittently energizing such top warning illumination, said circuit comprising the combination of:

means for producing a d.c. signal in response to energization of said top warning illumination and for producing an intermittent signal related to the "on" times of said flasher;

means responsive to said d.c. signal for detecting and indicating either when the top warning illumination has failed or when said flasher has failed in the "off" condition; and means responsive to said intermittent signal for detecting and indicating when said flasher has failed in the "on" condition.

2. A failure-detecting circuit for a signalling system having a pair of signalling lights and a flasher for regularly but intermittently emergizing said lights from a source of alternating voltage, said circuit comprising the combination of:

means for producing a d.c. signal whose amplitude is related to the current consumed by said lights and for producing an intermittent signal whose frequency is related to the frequency of energization of said lights;

means responsive to the magnitude of said d.c. signal for detecting and indicating when either of said lights has failed and for detecting and indicating when both of said lights have failed, whereby the first indication unambiguously defines a single light failure whereas the second indication defines either failure of the flasher in the "off" condition or failure of both lights; and means responsive to said intermittent signal for detecting and indicating when the flasher has failed in the "on" condition.

3. The failure-detecting circuit as defined in claim 2 wherein said means responsive to the d.c. signal comprises first and second comparators each receiving said d.c. signal and means for producing reference signals of different magnitudes with which the comparators respectively compare said d.c. signal.

4. The failure-detecting circuit as defined in claim 3 wherein the signalling system also includes a plurality of additional lights and means for continuously energizing them, and including means for producing a further d.c. signal whose amplitude is related to the current consumed by said additional lights, and means responsive to said further d.c. signal for detecting and indicating when one or more of said additional lights has failed.

5. The failure-detecting circuit as defined in claim 2 and wherein said means responsive to said intermittent signal includes a timing circuit in which the voltage value across a capacitor is increased during "on" times of the flasher, means for discharging the capacitor during "off" times of the flasher, and means responsive to said voltage value when it reaches a predetermined value exceeding that attained during a normal "on" time for detecting and indicating a failure of the flasher in the "on" condition.

6. The failure-detecting circuit as defined in claim 5 wherein the signalling system also includes a plurality of additional lights and means for continuously energizing them, and including means for producing a further d.c. signal whose amplitude is related to the current consumed by said additional lights and means responsive to said further d.c. signal for detecting and indicating when one or more of said additional lights has failed.

7. The failure-detecting circuit as defined in claim 6 wherein the means last mentioned comprises a comparator receiving said further d.c. signal and means for applying a d.c. voltage signal to such comparator with which the further d.c. signal is compared.

8. The failure-detecting circuit as defined in claim 2, 5, 6 or 7 including means responsive to remote actuation for testing the circuit.

9. The failure-detecting circuit as defined in claim 8 wherein the means last mentioned includes a remotely actuated latching relay for internally altering the connections of the circuit so that all detecting and indicating functions should respond.

10. The failure-detecting circuit as defined in claim 6 wherein the means last mentioned comprises a comparator receiving said further d.c. signal and means for applying a d.c. voltage signal to such comparator with which the further d.c. signal is compared.

* * * * *